US009441561B2

(12) United States Patent
Yeager

(10) Patent No.: US 9,441,561 B2
(45) Date of Patent: Sep. 13, 2016

(54) SYSTEM AND METHOD FOR INCREASING TOLERANCE TO FUEL VARIATION

(71) Applicant: CATERPILLAR INC., Peoria, IL (US)

(72) Inventor: Mary Louise Yeager, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 99 days.

(21) Appl. No.: 14/567,350

(22) Filed: Dec. 11, 2014

(65) Prior Publication Data

US 2016/0169132 A1 Jun. 16, 2016

(51) Int. Cl.

| | |
|---|---|
| ***F02D 41/00*** | (2006.01) |
| ***F02D 41/30*** | (2006.01) |
| ***F02D 41/26*** | (2006.01) |
| ***F02D 41/14*** | (2006.01) |
| ***F02D 37/02*** | (2006.01) |

(52) U.S. Cl.

CPC ..... *F02D 41/0027* (2013.01); *F02D 37/02* (2013.01); *F02D 41/1438* (2013.01); *F02D 41/26* (2013.01); *F02D 41/3005* (2013.01)

(58) Field of Classification Search

CPC .... F02D 41/00; F02D 41/0027; F02D 41/14; F02D 41/1438; F02D 41/26; F02D 41/30; F02D 41/3005

See application file for complete search history.

(56) References Cited

U.S. PATENT DOCUMENTS

| | | | | |
|---|---|---|---|---|
| 5,394,844 | A * | 3/1995 | Akimoto | F02D 33/003 123/179.17 |
| 5,878,717 | A | 3/1999 | Zur Loye | |
| 6,947,830 | B1 | 9/2005 | Froloff et al. | |
| 8,073,638 | B2 | 12/2011 | Birk et al. | |
| 8,590,515 | B2 | 11/2013 | Young et al. | |
| 8,789,514 | B2 | 7/2014 | Caretta et al. | |
| 8,935,996 | B2 * | 1/2015 | Mulye | F02B 47/02 123/25 A |
| 2011/0093181 | A1 | 4/2011 | Ciaravino et al. | |
| 2013/0297181 | A1 | 11/2013 | Wang et al. | |

FOREIGN PATENT DOCUMENTS

WO WO 2006/025958 3/2006

OTHER PUBLICATIONS

Mary Yeager et al., U.S. Appl. No. 14/567,418, filed Dec. 11, 2014.

* cited by examiner

*Primary Examiner* — Hieu T Vo

(74) *Attorney, Agent, or Firm* — Finnegan, Henderson, Farabow, Garrett & Dunner, LLP

(57) ABSTRACT

A fuel control system for a multiple fuel internal combustion engine may include at least one cylinder pressure sensor associated with each cylinder of the engine. A data collection module may be configured to receive real-time cylinder pressure measurements from each of the at least one cylinder pressure sensors and calculate one or more actual combustion parameter values from the real-time cylinder pressure measurements. A comparison module may be configured to receive the calculated one or more actual combustion parameter values from the data collection module and compare the calculated one or more actual combustion parameter values for each cylinder to theoretical combustion parameter values to determine any difference therebetween, wherein the theoretical combustion parameter values are derived independently from any actual combustion parameter values based on real-time sensor measurements. A process control module may be configured to control fuel injection of at least two different types of fuel supplied to each cylinder in order to reduce any difference between the calculated actual combustion parameter values for each cylinder and the theoretical combustion parameter values.

20 Claims, 4 Drawing Sheets

SYSTEM AND METHOD FOR INCREASING TOLERANCE TO FUEL VARIATION

TECHNICAL FIELD

The present disclosure relates generally to fuel variation for internal combustion engines, and more particularly, to a system and method for increasing tolerance to fuel variation.

BACKGROUND

Gaseous fuel powered engines and engines that operate on multiple different fuels are used in a variety of applications. Fuels for diesel engines of motor vehicles, such as diesel, biodiesel or gas-to-liquid fuel, i.e. liquid fuel obtained from natural gas, have very different fuel qualities. In particular, the ignitability of the fuel, which is important for the combustion in the cylinders of diesel engines and is usually expressed as the cetane index CCI or the cetane number, can vary considerably for different fuels. Even within the same types of fuel, combustion characteristics of the fuel such as the cetane index can vary widely.

An example of an internal combustion engine that can be reconfigured to operate with any given fuel from a range of combustible fuels is shown in U.S. Pat. No. 6,947,830 to Froloff et al. ("the '830 patent"). The '830 patent discloses a programmable computer system for an internal combustion engine configured to receive and process fuel combustion characteristic signals and data from various combustion events using different ignition methods. Detonation signals are processed from those combustion events to determine the fuel ignition method that will result in maximum power with allowable engine wear for a given fuel. Although the '830 patent purports to have the flexibility to run on a wide variety of fuels, a great deal of complexity of design and control is required in order to accommodate a variety of different ignition modes including spark ignition, homogeneous charge compression ignition, compression ignition, and combinations of the different ignition modes. Tests must be administered at engine start such that the engine is essentially controlled to act as a laboratory for a period of time in order to determine the least engine damaging ignition method to use that will also yield the highest power output for a particular fuel. These required test periods and reconfiguration of the engine to accommodate different modes of ignition may increase operating costs and reduce the ability of the engine to adjust quickly to different qualities of fuel that may be obtained at each refueling.

The wide range of different types of fuel and quality of the fuel that may be used by single fuel or multiple fuel engines makes it prohibitively expensive to test and verify an engine for this entire range of fuels. The different combustion characteristics of different types of fuel, and even for the same type of fuel obtained from different sources, creates a need for control systems that are able to automatically adjust for different fuels having different combustion characteristics while optimizing engine performance.

The disclosed system is directed to overcoming one or more of the problems set forth above and/or other problems with existing technologies.

SUMMARY OF THE DISCLOSURE

According to an aspect of the present disclosure, a control system for a multiple fuel internal combustion engine may include at least one cylinder pressure sensor associated with each cylinder of the engine. The control system may further include a data collection module configured to receive real-time cylinder pressure measurements from each of the at least one cylinder pressure sensors and calculate one or more actual combustion parameter values from the real-time cylinder pressure measurements. The control system may still further include a comparison module configured to receive the calculated one or more actual combustion parameter values from the data collection module and compare the calculated one or more actual combustion parameter values for each cylinder to theoretical combustion parameter values to determine any difference therebetween, wherein the theoretical combustion parameter values are derived independently from any actual combustion parameter values based on real-time sensor measurements. The control system may also include a process control module configured to control at least one of fuel injection of the fuel supplied to each cylinder and ignition timing based on any difference between the calculated actual combustion parameter values for each cylinder and the theoretical combustion parameter values.

According to another aspect of the present disclosure, a multiple fuel internal combustion engine operable in a combined liquid and gaseous fuel mode may include a plurality of cylinders, a real-time cylinder pressure sensor associated with each of the plurality of cylinders, a liquid fuel injection system, a gaseous fuel injection system, and a control system. The control system may include a data collection module configured to receive real-time cylinder pressure measurements from each of the cylinder pressure sensors and calculate one or more actual combustion parameter values from the real-time cylinder pressure measurements. The control system may further include a comparison module configured to receive the calculated one or more actual combustion parameter values from the data collection module and compare the calculated one or more actual combustion parameter values for each cylinder to theoretical combustion parameter values to determine any difference therebetween, wherein the theoretical combustion parameter values are derived independently from any actual combustion parameter values based on real-time sensor measurements. The control system may also include a process control module configured to control fuel injection of the fuel supplied to each cylinder based on any difference between the calculated actual combustion parameter values for each cylinder and the theoretical combustion parameter values.

According to another aspect of the present disclosure, a method for controlling a multiple fuel internal combustion engine operable in at least a combination liquid and gaseous fuel mode may include receiving real-time cylinder pressure measurements from each of the cylinders of the multiple fuel internal combustion engine. The method may further include calculating one or more actual combustion parameter values based on the real-time cylinder pressure measurements. The method may still further include comparing the calculated actual combustion parameter values for each cylinder to theoretical combustion parameter values to determine any difference therebetween, wherein the theoretical combustion parameter values are derived independently from any actual combustion parameter values based on real-time sensor measurements. The method may also include controlling one or more of fuel injection of at least a liquid fuel and a gaseous fuel, and ignition based on any difference between the calculated actual combustion parameter values for each cylinder and the theoretical combustion parameter values.

Other features and aspects of this disclosure will be apparent from the following description and the accompanying drawings.

DETAILED DESCRIPTION

Figure 1:
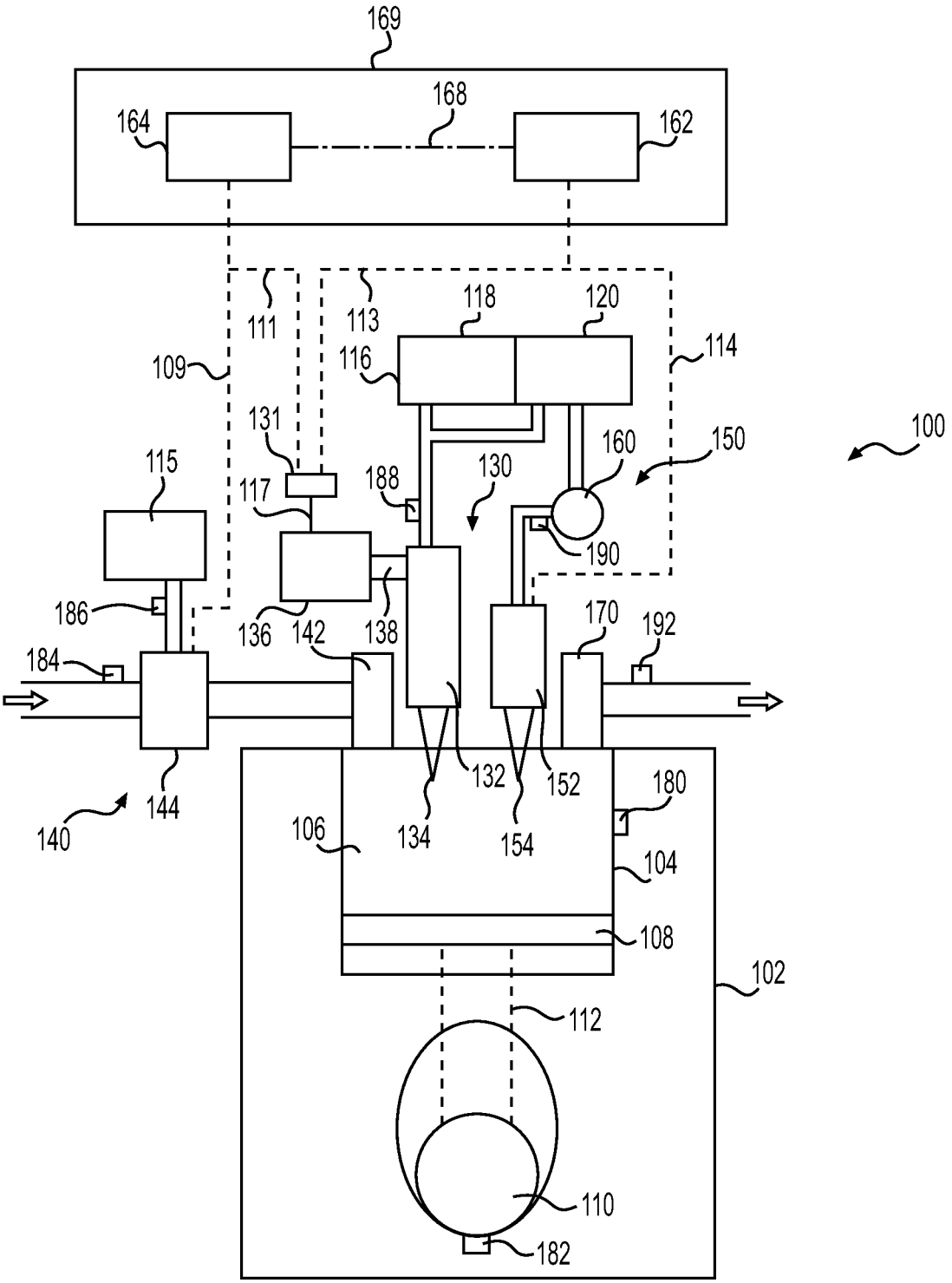
FIG. 1 shows an exemplary schematic diagram of a multiple fuel internal combustion engine.

FIG. 1 illustrates an exemplary implementation of a multiple fuel internal combustion engine 100 that may be operated with different types of fuel, such as heavy fuel oil (HFO), diesel fuel, gasoline, and natural gas. The exemplary multiple fuel internal combustion engine 100 may be operated in a liquid fuel mode, a gaseous fuel mode, and a combination liquid and gaseous fuel mode.

During a liquid fuel mode, a liquid fuel injection system 130 provides liquid fuel to the charge air within a combustion chamber 106, and the charge air/liquid fuel mixture may be ignited by compression. Diesel engines and homogeneous charge compression ignition (HCCI) engines rely on auto-ignition for the initiation of combustion, in contrast to spark ignition engines such as gasoline powered engines. In a spark ignition engine auto-ignition is undesirable because it causes knock, and too much knock can create stresses on the engine that exceed an acceptable threshold level. The tendency of a fuel to auto-ignite is inversely proportional to the octane level of the fuel. In high performance, high compression spark ignition engines, a higher octane fuel may be required to avoid undesirable knock. Fuels for diesel engines and HCCI engines that rely on auto-ignition for initiation of combustion are typically given a cetane rating that is the direct opposite of the octane rating since the cetane rating is a measure of a fuel's tendency toward auto-ignition. Gaseous fuels such as CNG are more difficult to auto-ignite than diesel fuel, typically requiring a compression ratio for auto-ignition that may be more than ten times as high as a compression ratio that results in auto-ignition of a diesel fuel. Therefore, different methods of blending gaseous fuels with liquid fuels for ignition purposes have been developed. During a gaseous fuel mode, a gaseous fuel such as natural gas may be controllably released into an air intake port connected to a cylinder 104, producing a charge air/gaseous fuel mixture. In a combination liquid and gaseous fuel mode, after a predetermined period of time, a small amount of diesel fuel may be injected into the cylinder 104 containing a charge air/gaseous fuel mixture in order to ignite the fuel mixture. The amount of the diesel fuel used as an ignition fuel may be about 3% of the fuel amount injected during a liquid fuel mode. Compression ignites the diesel fuel, which in turn ignites the charge air/gaseous fuel mixture. To operate in a liquid fuel mode as well as a gaseous fuel mode, a control system for a multiple fuel internal combustion engine may control components of the liquid fuel injection system 130, a gaseous fuel injection system 140, and an ignition fuel injection system 150.

Referring to FIG. 1, an exemplary schematic diagram of a multiple fuel internal combustion engine 100 including an engine unit, an air system, a fuel system, and a control system is shown. The engine unit may include an engine block 102, at least one cylinder 104 providing at least one combustion chamber 106 for combusting fuel, a piston 108, and a crank-shaft 110 connected to the piston 108 via a piston rod 112. The piston 108 may be configured to reciprocate within the cylinder 104.

In various implementations according to this disclosure, the multiple fuel internal combustion engine 100 may be used as a power source on an off-highway mining truck, a large marine vessel for propulsion, in a petroleum application such as well fracking or drilling, and other applications that may benefit from the flexibility offered by such engines. In some of these implementations the multiple fuel internal combustion engine may use multiple fuels in a dynamic gas blending (DGB) mode. A DGB mode may be characterized by gaseous fuel being injected and mixed with air in the cylinders 104, and a subsequent injection of liquid fuel may ignite the air/gaseous fuel mixture. In alternative implementations of this disclosure, a single fuel engine such as a natural gas spark ignited engine may also be operated with different grades or qualities of natural gas.

The air system may include an inlet valve 142 fluidly connected to the at least one combustion chamber 106, and an outlet valve 170 also fluidly connected to the at least on combustion chamber 106. The inlet valve 142 may be configured to enable injection of compressed charge air and/or a mixture of compressed charge air and gaseous fuel into the at least one combustion chamber 106. After combusting the liquid fuel and/or gaseous fuel, the exhaust may be released out of the at least one combustion chamber 106 via the outlet valve 170 into an associated exhaust gas system (not shown) for treating the exhaust gas.

The fuel system may include a gaseous fuel tank 115 for storing the gaseous fuel, for example natural gas, and a liquid fuel tank unit 116, which may include a first liquid fuel tank 118 for storing, for example, HFO, or biodiesel oil, and a second liquid fuel tank 120 for storing, for example, diesel fuel. The fuel system may further include the liquid fuel injection system 130, the gaseous fuel injection system 140, and the ignition fuel injection system 150. The liquid fuel injection system 130 may be configured to inject liquid fuel originating from the liquid fuel tank unit 116 into the at least one combustion chamber 106. A liquid fuel injector 132 may be supplied with HFO, biodiesel oil, or other liquid fuel from the first liquid fuel tank 118 or with diesel fuel from the second liquid fuel tank 120.

The liquid fuel injector 132 may include a liquid fuel injector nozzle 134 fluidly communicating with the at least one combustion chamber 106. An actuator 136 may be configured to control the amount of liquid fuel provided to the liquid fuel injector 132. The actuator 136 may be a mechanical actuator connected to the liquid fuel injector 132 via a fuel rack 138 for controlling the amount of injected liquid fuel, or more typically, an electrical solenoid actuator or piezoelectric actuator driven by a control signal received from an engine control unit.

The gaseous fuel injection system 140 may be configured to inject gaseous fuel originating from the gaseous fuel tank 115 into the at least one combustion chamber 106. The gaseous fuel injection system 140 may include a gas admission valve 144, for example a solenoid-actuated or electro-hydraulic-actuated gas admission valve, which may be arranged upstream of the inlet valve 142 and may be configured to mix gaseous fuel originating from the gaseous fuel tank 115 with compressed charge air. The mixture of gaseous fuel and compressed charge air may be injected into the at least one combustion chamber 106 via the inlet valve 142.

The ignition fuel injection system 150 may be configured to inject a small amount of liquid fuel, preferably diesel fuel or other high cetane fuel, into the at least one combustion chamber 106. The ignition fuel injection system 150 may include an ignition fuel injector 152 having an ignition fuel injector nozzle 154 that is in fluid communication with the at least one combustion chamber 106 and a common rail system 160 receiving diesel fuel from the second liquid fuel tank 120 of the liquid fuel tank 116. The ignition fuel injector 152 may be supplied with diesel fuel from the common rail system 160. In some implementations, the ignition fuel injection system 150 may be also configured to inject liquid fuel into the at least one combustion chamber 106 during the liquid fuel mode. This may prevent the ignition fuel injector nozzle 54 from being blocked by, for example, soot resulting from the combusting process. In various alternative implementations, fuel injectors may be provided that inject both gaseous fuel and diesel fuel according to a selected one of a plurality of combustion modes.

In one exemplary implementation, a control system may be configured to select between a high pressure direct injection (HPDI) mode and at least one gas blending mode. In the HPDI mode, high pressure gaseous fuel may be injected after a liquid fuel injection, igniting at some point during compression of the fuels. In the gas blending mode(s), gaseous fuel may be injected and mixed with air in the cylinder, and a subsequent injection of liquid fuel may ignite the air/gaseous fuel mixture. In some implementations, the control system may be configured to select between at least two dynamic gas blending modes, including a direct injection-dynamic gas blending (DI-DGB) and a dynamic gas blending (DGB) mode The control system may comprise a control unit 169 including a first electronic control module 162, a second electronic control module 164, and several control lines connected to the respective components of the fuel system. The first electronic control module 162 may be connected to the second electronic control module 164 via a bus 168. One of ordinary skill in the art will recognize that in various alternative implementations one or more electronic control modules may be provided at one or more locations. The functions performed by the first and second electronic control modules of the exemplary implementation shown in FIG. 1 may be performed by a single electronic control module.

The first electronic control module 162 may be configured to control the liquid fuel mode of the multiple fuel internal combustion engine 100. Specifically, the first electronic control module 162 may be connected to the actuator 136 via a connection line 113 and a hardware connection, such as a relay 131. The hardware connection may also be embodied by multiple relays 131. The hardware connection may alternatively or in addition be embodied by a diode or by multiple diodes. Diodes may allow a continuous connection rather than a switched connection between the first electronic control module 162 and the fuel rack actuator 136.

During the liquid fuel mode, the first electronic control module 162 may provide a liquid fuel amount control signal to the fuel rack actuator 136 via the connection line 113. The liquid fuel amount control signal may indicate a desired liquid fuel amount to be injected into the at least one combustion chamber 106. In addition, the first electronic control module 162 may be configured to generally control the multiple fuel internal combustion engine 100 such as by controlling the engine speed and delivered fuel/power from the engine. Moreover, during the gaseous fuel mode, the first electronic control module 162 may be configured to control the ignition fuel injection system 150 via a connection line 114.

The second electronic control module 164 may be configured to control the gaseous fuel mode of the multiple fuel internal combustion engine 100. Specifically, the second electronic control module 164 may be connected to the gas admission valve 144 via a connection line 109. Furthermore, the second electronic control module 164 may be connected to the actuator 136 via a connection line 111 and the relay 131. During the gaseous fuel mode, the second electronic control module 164 may provide a gaseous fuel amount control signal to the gaseous admission valve 144 via the connection line 109. The gaseous fuel amount control signal may indicate a desired gaseous fuel amount to be mixed with compressed charge air within the gaseous admission valve 144, which mixture may be injected into the at least one combustion chamber 106. At the same time, the first electronic control module 162 may provide an ignition fuel amount control signal to the ignition fuel injector 152 via the connection line 114. The ignition fuel amount control signal may indicate a desired ignition fuel amount to be injected into the at least one combustion chamber 106 for igniting the gaseous mixture. For example, the small amount of injected ignition liquid fuel may be about 3% of the amount of injected liquid fuel during the liquid fuel mode. One of ordinary skill in the art will recognize that alternative implementations may include controlling the gas admission valve 144 by hydraulic and/or electrohydraulic means. The liquid fuel may also serve as the hydraulic fluid used to control actuation of the gas admission valve. The first and second electronic control modules 162, 164 may also control the timing of injections of liquid and gaseous fuels in a manner that controls when auto-ignition will occur.

The control system may further include several sensors for measuring actual operational parameter values of the multiple fuel internal combustion engine 100. For example, the control system may include a cylinder pressure sensor 180 for sensing the pressure within the at least one combustion chamber 106, a crank shaft speed sensor 182 for measuring the speed of the crank shaft 110, a charge air pressure sensor 184 for measuring the pressure of the compressed charge air, a gaseous fuel pressure sensor 186 for measuring the pressure of the gaseous fuel, a liquid fuel pressure sensor 188 for measuring the pressure of the liquid fuel, a common rail pressure sensor 190 for measuring the pressure of the liquid fuel within the common rail 160, and an exhaust gas pressure sensor 192 for measuring the pressure of the exhaust gas released out of the at least one combustion chamber 106. The control system may also include other sensors, such as rotational speed sensors, timing sensors, transmission gear position sensors, gas constituent sensors, and other sensors measuring various vehicle, engine, and combustion parameters.

Figure 2:
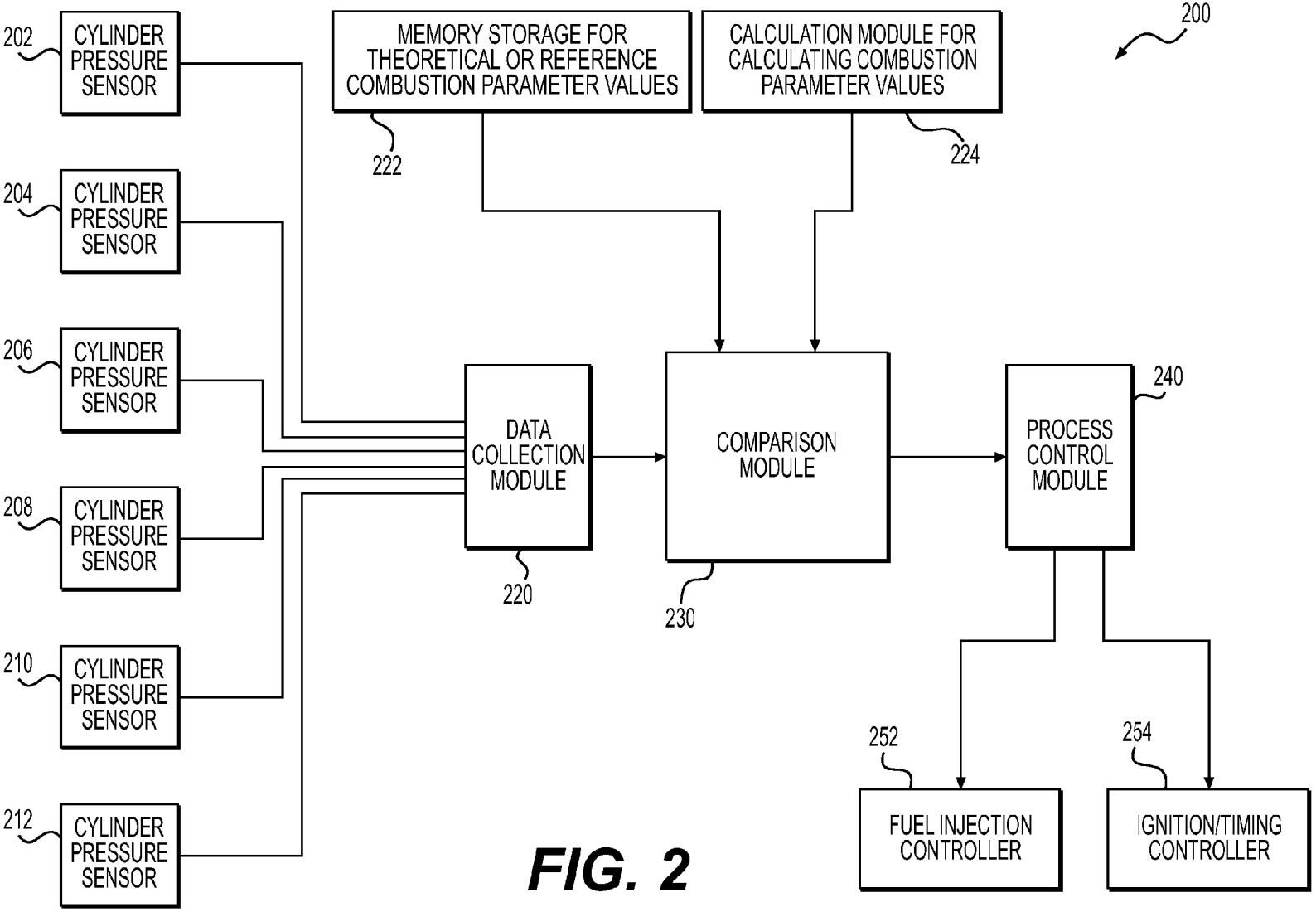
FIG. 2 shows a schematic diagram of a control system for a multiple fuel internal combustion engine.

FIG. 2 illustrates an exemplary implementation of a control system 200 according to this disclosure, wherein only cylinder pressure sensors are shown as the sensors providing input to the control system. One of ordinary skill in the art will recognize that a large variety of sensors measuring various engine operating and combustion parameters such as those discussed above may all provide input to the control system. In the exemplary implementation of FIG. 2, cylinder pressure sensors 202, 204, 206, 208, 210, 212 may each be associated with a different cylinder of a multiple fuel internal combustion engine. Multiple cylinder pressure sensors may also be provided for each cylinder at different locations on each cylinder if desired. In certain alternative implementations it may be desirable to only instrument one cylinder with a cylinder pressure sensor in order to reduce costs. A data collection module 220 may be configured to receive real-time cylinder pressure measurements from each of the at least one cylinder pressure sensors. The data collection module 220 of the control system 200 may also be configured to calculate one or more actual combustion parameter values from the real-time cylinder pressure measurements received from the cylinder pressure sensors.

A comparison module 230 of control system 200 may be configured to receive the calculated one or more actual combustion parameter values from the data collection module 220 and compare the calculated one or more actual combustion parameter values for each cylinder to theoretical combustion parameter values to determine any difference therebetween, wherein the theoretical combustion parameter values are derived independently from any actual combustion parameter values based on real-time sensor measurements, and may be based on expected combustion parameter values for the one or more types of fuel being combusted in each cylinder. In an alternative implementation wherein fewer than all of the cylinders are provided with a cylinder pressure sensor, the comparison module 230 may be configured to compare the calculated actual combustion parameter values for the cylinders that are provided with cylinder pressure sensors to the theoretical combustion parameter values.

A process control module 240 may be configured to control at least one of fuel injection of at least two different types of fuel supplied to each cylinder, and ignition timing in order to reduce any difference between the calculated actual combustion parameter values for each cylinder and the theoretical combustion parameter values. A fuel injection controller 252 may be configured to control both liquid fuel injection and gaseous fuel injection, such as performed by the first electronic control module 162 and the second electronic control module 164 in the exemplary implementation of FIG. 1. An ignition/timing controller 254 may be configured to implement the desired timing of ignition and/or fuel injection. Because there may be a delay between when an ignition fuel such as diesel fuel is first injected into the cylinder and when auto-ignition from compression actually begins, the timing of ignition may be controlled by the timing of injection of the ignition fuel. The comparison module 230 may be configured to receive the theoretical combustion parameter values from one or more of a memory storage 222 and a calculation module 224. One of ordinary skill in the art will recognize that the various modules shown in the exemplary implementation of FIG. 2 may be combined into one or more processors, and embodied in one or more of software, hardware, firmware, or any combination thereof.

Figure 3:
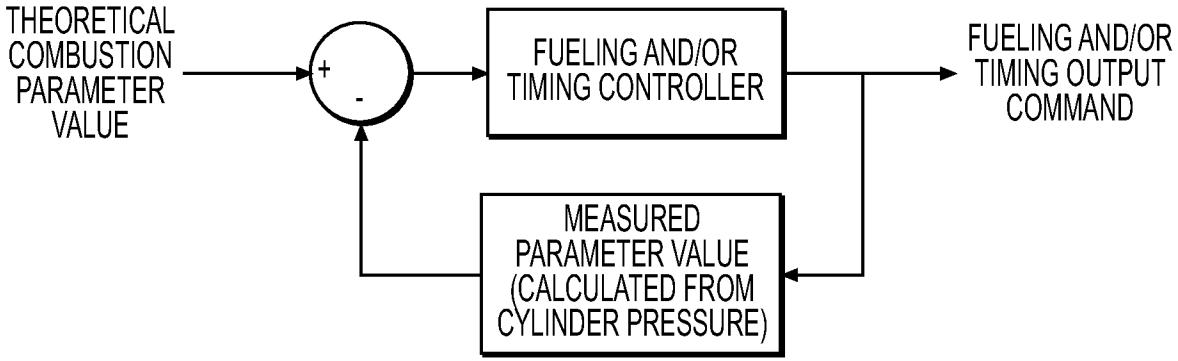
FIG. 3 shows an exemplary block diagram illustrating a closed loop control of a cylinder of the multiple fuel internal combustion engine of FIG. 1.
Figure 4:
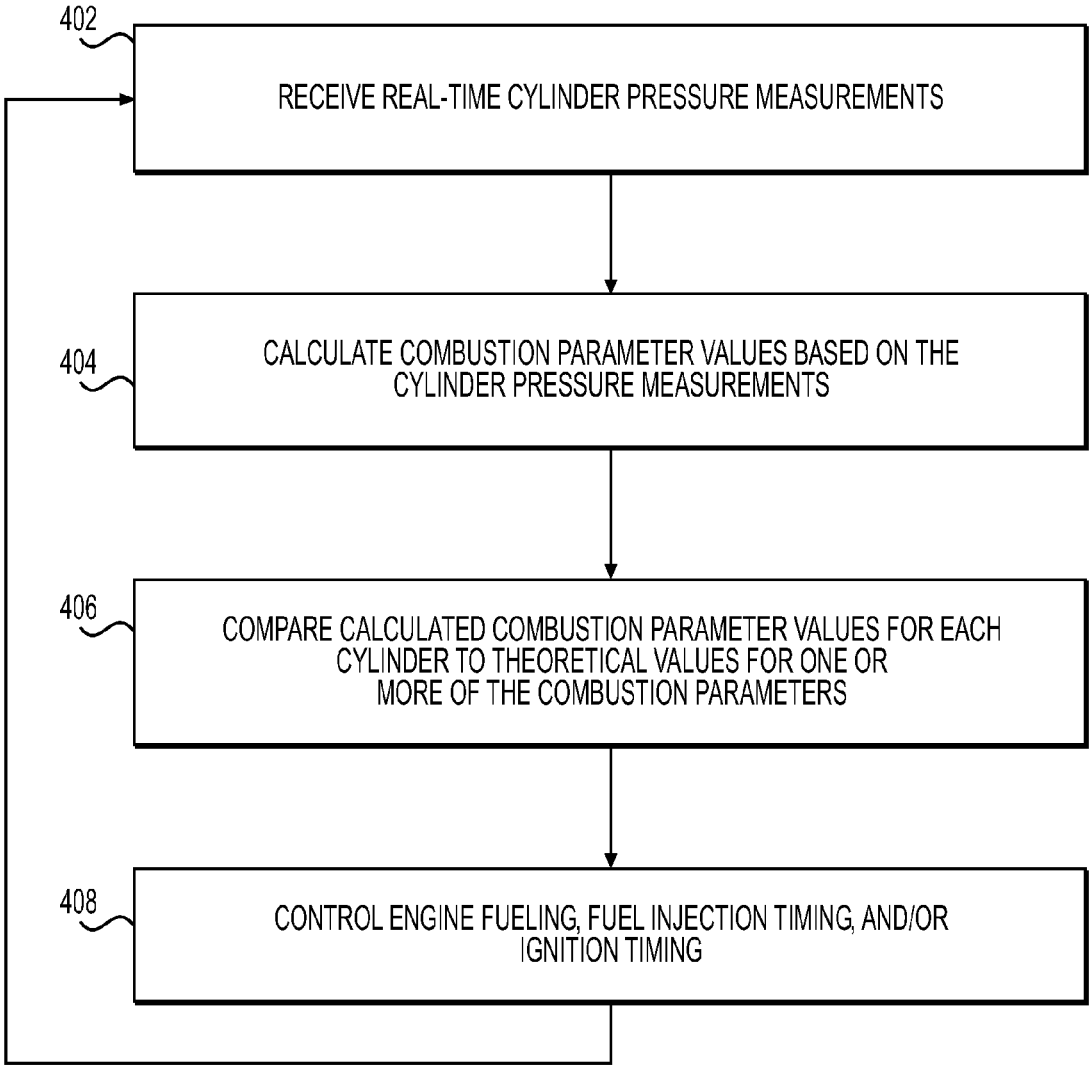
FIG. 4 shows a flow diagram illustrating steps of the closed loop control of FIG. 3.

An exemplary implementation of a closed loop process that may be implemented by the above-described control system is shown in FIGS. 3 and 4, which will be described in detail in the following section.

INDUSTRIAL APPLICABILITY

The disclosed control system is applicable to any multiple fuel internal combustion engine or single fuel internal combustion engine, and provides a method for implementing a desired operational characteristic such as optimizing the power output of the engine, minimizing fuel consumption, or reducing emissions, regardless of the fuel that is used. Fuel quality may vary widely for fuels of different types, and even for fuels of the same type, but obtained from different sources or at different times. Therefore, systems and methods for automatically adjusting one or more of engine fueling, injection timing, or spark ignition in order to compensate for these variances may be beneficial.

The use of greater amounts of gaseous fuel such as CNG in a multiple fuel internal combustion engine may impose higher stresses on the engine as a result of higher compression ratios and the potential for increased engine knock. Variations in physical and operational characteristics from one cylinder to another may result in limitations on the maximum amount of gaseous fuel that can be used. Different cylinders may produce different amounts of power, different levels of emissions, different amounts of knock, or other variables. As one example, a cylinder producing more knock than all of the other cylinders may be the limiting factor for how much gaseous fuel the engine may burn. Accurate, real-time measurement of actual combustion parameter values for each of the cylinders may allow for adjustments to controls for each cylinder in order to reduce any difference between actual combustion parameter values and theoretical combustion parameter values. The theoretical combustion parameter values may be derived independently from any actual combustion parameter values based on real-time sensor measurements, and may be based on expected combustion parameter values for the one or more types of fuel being combusted in each cylinder. The theoretical combustion parameter values may be combustion parameter values based on a theoretical power output that the multiple fuel internal combustion engine can produce with the same types and quantities of fuel as are currently being combusted by the engine. Alternatively or in addition, the theoretical combustion parameter values may be combustion parameter values based on a theoretical amount of emissions that the multiple fuel internal combustion engine can produce with the same types of fuel as are currently being combusted by the engine.

The calculated one or more actual combustion parameter values and the theoretical combustion parameter values may be selected in order to allow for improvement of a desired characteristic such as the total power output of the engine, or reduction in the amount of emissions produced by the engine. Combustion parameter values may include peak cylinder pressure, indicated mean effective pressure (IMEP), maximum heat released, maximum rate of heat release, maximum rate of pressure rise, estimated combustion gas temperature, location of peak cylinder pressure, location of maximum rate of pressure rise, crank angle of start of combustion, crank angle of center of combustion, and crank angle of opening or closing of an inlet or outlet valve for each of the cylinders. Various combustion parameters, such as the crank angle of opening or closing of an inlet or outlet valve may be varied using engine control electronics. The theoretical combustion parameter values may be readily available values for each different type of fuel being used by an engine, based on theoretical, physics-based calculations, and may therefore enable a rapid initiation of a closed loop control to reduce any difference between the calculated actual combustion parameter values and the theoretical combustion parameter values.

A closed loop process such as shown in FIGS. 3 and 4 may be initiated in order to rapidly determine optimal engine operating characteristics regardless of the quality of the fuel that is being used by the engine. As shown in FIG. 3, any one or more cylinders may be controlled in accordance with the illustrated closed loop process. For each cylinder, a theoretical combustion parameter value may be compared to a measured parameter value that has been calculated from an actual, real-time cylinder pressure measured by a cylinder pressure sensor for that cylinder. The results of that comparison may then be used to send signals to fueling and/or timing controllers. The fueling and/or timing controllers produce output commands, and new cylinder pressure readings are used to update the measured parameter values, which are again compared to the theoretical combustion parameter values. The timing controllers may alter timing of injection of fuels, timing of a spark in the case of a spark-ignited engine, and the timing of opening or closing of an inlet or outlet valve for each of the cylinders. The theoretical combustion parameter values against which any one or more of the cylinders may be evaluated may be selected from a calibration curve, map, or other data source. The theoretical combustion parameter values may have been derived from physics-based calculations, independently from any actual combustion parameter values based on real-time sensor measurements.

Alternative implementations may use a feed-forward process rather than a closed loop process. In the feed-forward process, measured cylinder pressure parameters may be correlated to well-known fuel descriptors such as cetane number, methane number, lower heating value, specific gravity, etc. Some of these descriptors may have been typically detected with expensive gas quality sensors and/or entered manually into a service tool or via a GUI panel on the engine. These same fuel descriptors may be calculated based on the cylinder pressure measurements obtained from one or more cylinder pressure sensors. A feed-forward control block may translate the fuel descriptors into fueling and/or timing adjustments using static maps, calculations or algorithms. A feed-forward process without a closed loop control may allow a fueling and/or timing controller to make an immediate adjustment to the system response based on knowledge of the engine's fuel characteristics.

In still further alternative implementations the feed-forward process may be used for some cylinder pressure parameters, and the closed loop process may be used for other cylinder pressure parameters. A control method that uses both feed-forward and closed loop processes may be desirable, for example, if certain cylinder pressure parameters are discovered to vary by small amounts in spite of large differences in fuel quality, while other cylinder pressure parameters are discovered to vary by large amounts as the quality of the fuel changes. The cylinder pressure parameters that vary little with changes in fuel quality may be best suited for feed-forward processes, while cylinder pressure parameters that vary by large amounts as the fuel quality changes may require a closed loop process of adjusting fueling and/or timing in order to provide accurate system response. The rates of execution of each of the feed-forward processes and closed loop processes may be different so as to not create an instability condition.

As shown in FIG. 3, the process may be performed in a closed loop for any individual cylinder 104 of the multiple fuel internal combustion engine 100. Actual combustion parameter values may be calculated for one or more cylinders 104 from real-time cylinder pressure measurements taken by cylinder pressure sensors 180 in the one or more cylinders 104. These one or more actual combustion parameter values may then be compared to a theoretical combustion parameter value for the one or more types of fuel being used by the engine. Fueling and/or timing controllers may then produce fueling and/or timing output commands to control one or more of fuel injection of at least a liquid fuel and a gaseous fuel into each cylinder 104, and ignition of the fuel in each cylinder 104 in order to reduce any difference between the calculated actual combustion parameter values for each cylinder and the theoretical combustion parameter values. In the case of auto-ignition of the fuel, such as with diesel engines and HCCI engines, the timing of ignition may be controlled indirectly by the timing of injection of a pilot fuel such as diesel fuel, which will auto-ignite upon reaching a certain compression. Spark ignition engines control the timing of ignition by controlling the timing of the spark. This process may be continued in a closed loop until the difference between the calculated actual combustion parameter values for each cylinder and the theoretical combustion parameter values is less than a threshold level.

As shown in FIG. 4, the process for any one cylinder 104 may begin at step 402 with a controller receiving real-time cylinder pressure measurements from one or more cylinder pressure sensors 180 located in the cylinder 104. At step 404 a data collection module 220 may then calculate actual combustion parameter values based on the cylinder pressure measurements.

At step 406 a comparison module 230 may compare the calculated actual combustion parameter values for the cylinder 104 to the same theoretical combustion parameter value used for all of the other cylinders 104. The comparison module 230 may have received the theoretical combustion parameter values from a memory storage 222 or a calculation module 224. The calculation module 224 may be configured to derive the theoretical combustion parameter values independently from any actual combustion parameter values based on real-time sensor measurements. The theoretical combustion parameter values may be based on expected combustion parameter values for the one or more types of fuel being combusted in each cylinder. Expected combustion parameter values may have been calculated using known, physics-based calculations or algorithms based on the physical parameters of the engine, chemical characteristics of the type of fuel, and known thermodynamics of the combustion process for each type of fuel in an engine with known physical parameters.

When the difference between the calculated actual combustion parameter values for one or more cylinders and the theoretical combustion parameter values is above a desired threshold level, a process control module 240 may control one or more of engine fueling, fuel injection timing, and ignition timing for each of the cylinders 104 at step 408 in order to attempt to bring the calculated actual combustion parameter values into line with the theoretical combustion parameter values. The process may be continued in a closed loop by returning to step 402 after controlling operational parameters for each cylinder 104 at step 408 and again receiving real-time cylinder pressure measurements for each cylinder 104 at step 402.

It will be apparent to those skilled in the art that various modifications and variations can be made to the disclosed control system. Other embodiments will be apparent to those skilled in the art from consideration of the specification and practice of the disclosed concepts. It is intended that the specification and examples be considered as exemplary only, with a true scope being indicated by the following claims and their equivalents.

The invention claimed is:

1. A control system for a multiple fuel internal combustion engine, comprising:

at least one cylinder pressure sensor associated with each cylinder of the engine;

a data collection module configured to receive real-time cylinder pressure measurements from each of the at least one cylinder pressure sensors and calculate one or more actual combustion parameter values from the real-time cylinder pressure measurements;

a comparison module configured to receive the calculated one or more actual combustion parameter values from the data collection module and compare the calculated one or more actual combustion parameter values for each cylinder to theoretical combustion parameter values to determine any difference therebetween, wherein the theoretical combustion parameter values are derived independently from any actual combustion parameter values based on real-time sensor measurements; and a process control module configured to control fuel injection of at least two different types of fuel supplied to each cylinder in order to reduce any difference between the calculated actual combustion parameter values for each cylinder and the theoretical combustion parameter values.

2. The control system of claim 1, wherein the comparison module is further configured to receive the theoretical combustion parameter values from a memory storage.

3. The control system of claim 2, wherein the theoretical combustion parameter values from the memory storage are combustion parameter values based on a theoretical power output that the multiple fuel internal combustion engine can produce with the same types and quantities of fuel as are currently being combusted by the engine while staying within allowable stress limits for the engine.

4. The control system of claim 2, wherein the theoretical combustion parameter values from the memory storage are combustion parameter values based on a theoretical amount of emissions that the multiple fuel internal combustion engine will produce with the same types and quantities of fuel as are currently being combusted by the engine.

5. The control system of claim 1, wherein the calculated one or more actual combustion parameter values and the theoretical combustion parameter values include one or more of peak cylinder pressure, indicated mean effective pressure (IMEP), maximum heat released, crank angle of start of combustion, crank angle of center of combustion, and crank angle of opening or closing of an inlet or outlet valve for each of the cylinders of the multiple fuel internal combustion engine.

6. The control system of claim 5, wherein the theoretical combustion parameter values are combustion parameter values based on a theoretical power output that the multiple fuel internal combustion engine can produce with the same types and quantities of fuel as are currently being combusted by the engine.

7. The control system of claim 1, wherein the process control module is further configured to control the timing of one or more of fuel injection of at least two different types of fuel and ignition of the at least two different types of fuel.

8. The control system of claim 1, further including the data collection module being configured to recalculate one or more actual combustion parameter values from new real-time cylinder pressure measurements taken after the process control module controls fuel injection of at least two different types of fuel in order to reduce any difference between the calculated actual combustion parameter values for each cylinder and the theoretical combustion parameter values, the recalculation by the data collection module continuing in a closed loop process until the difference between the calculated actual combustion parameter values and the theoretical combustion parameter values is less than a predetermined threshold.

9. The control system of claim 1, wherein the comparison module is further configured to receive the theoretical combustion parameter values from a calculation module configured to calculate the theoretical combustion parameter values using known, physics-based calculations based on the physical parameters of the engine, chemical characteristics of the type of fuel, and known thermodynamics of the combustion process for each type of fuel being used by the multiple fuel internal combustion engine.

10. A multiple fuel internal combustion engine operable in a combined liquid and gaseous fuel mode; comprising:

a plurality of cylinders;

a real-time cylinder pressure sensor associated with each of the plurality of cylinders;

a liquid fuel injection system;

a gaseous fuel injection system; and a control system comprising:

a data collection module configured to receive real-time cylinder pressure measurements from each of the cylinder pressure sensors and calculate one or more actual combustion parameter values from the real-time cylinder pressure measurements;

a comparison module configured to receive the calculated one or more actual combustion parameter values from the data collection module and compare the calculated one or more actual combustion parameter values for each cylinder to theoretical combustion parameter values to determine any difference therebetween, wherein the theoretical combustion parameter values are derived independently from any actual combustion parameter values based on real-time sensor measurements; and a process control module configured to control one or more of fuel injection of at least a liquid fuel and a gaseous fuel, and ignition in order to reduce any difference between the calculated actual combustion parameter values for each cylinder and the theoretical combustion parameter values.

11. The multiple fuel internal combustion engine of claim 10, wherein the comparison module is further configured to receive the theoretical combustion parameter values from a memory storage.

12. The multiple fuel internal combustion engine of claim 11, wherein the theoretical combustion parameter values from the memory storage are combustion parameter values based on a theoretical power output that the multiple fuel internal combustion engine can produce with the same types and quantities of fuel as are currently being combusted by the engine while staying within allowable stress limits for the engine.

13. The multiple fuel internal combustion engine of claim 11, wherein the theoretical combustion parameter values from the memory storage are combustion parameter values based on a theoretical amount of emissions that the multiple fuel internal combustion engine will produce with the same types and quantities of fuel as are currently being combusted by the engine.

14. The multiple fuel internal combustion engine of claim 10, wherein the calculated one or more actual combustion parameter values and the theoretical combustion parameter values include one or more of peak cylinder pressure, indicated mean effective pressure (IMEP), maximum heat released, crank angle of start of combustion, crank angle of center of combustion, and crank angle of opening or closing of an inlet or outlet valve for each of the cylinders of the engine.

15. The multiple fuel internal combustion engine of claim 14, wherein the theoretical combustion parameter values are combustion parameter values based on a theoretical power output that the multiple fuel internal combustion engine can produce with the same types and quantities of fuel as are currently being combusted by the engine while staying within allowable stress limits for the engine.

16. The multiple fuel internal combustion engine of claim 10, wherein the process control module is further configured to control the timing of one or more of fuel injection of at least two different types of fuel and ignition of the at least two different types of fuel.

17. The multiple fuel internal combustion engine of claim 10, further including the data collection module being configured to recalculate one or more actual combustion parameter values from new real-time cylinder pressure measurements taken after the process control module controls one or more of fuel injection and ignition in order to reduce any difference between the calculated actual combustion parameter values for each cylinder and the theoretical combustion parameter values, the recalculation by the data collection module continuing in a closed loop process until the difference between the calculated actual combustion parameter values and the theoretical combustion parameter values is less than a predetermined threshold.

18. The multiple fuel internal combustion engine of claim 10, wherein the comparison module is further configured to receive the theoretical combustion parameter values from a calculation module configured to calculate the theoretical combustion parameter values using known, physics-based calculations based on physical parameters of the engine, chemical characteristics of each type of fuel, and known thermodynamics of a combustion process for each type of fuel being used by the multiple fuel internal combustion engine.

19. A method for controlling a multiple fuel internal combustion engine operable in at least a combination liquid and gaseous fuel mode, the method comprising:

receiving real-time cylinder pressure measurements from each of the cylinders of the multiple fuel internal combustion engine;

calculating one or more actual combustion parameter values based on the real-time cylinder pressure measurements;

comparing the calculated actual combustion parameter values for each cylinder to theoretical combustion parameter values to determine any difference therebetween, wherein the theoretical combustion parameter values are derived independently from any actual combustion parameter values based on real-time sensor measurements; and controlling one or more of fuel injection of at least a liquid fuel and a gaseous fuel, and ignition in order to reduce any difference between the calculated actual combustion parameter values for each cylinder and the theoretical combustion parameter values.

20. The method of claim 19, wherein the theoretical combustion parameter values are combustion parameter values based on a theoretical power output that the multiple fuel internal combustion engine can produce with the same types and quantities of fuel as are currently being combusted by the engine while staying within allowable stress limits for the engine.

* * * * *